US009777474B2

(12) United States Patent
Sato

(10) Patent No.: US 9,777,474 B2
(45) Date of Patent: Oct. 3, 2017

(54) VIBRATION CONTROL WALL STRUCTURE

(71) Applicant: IDEAL BRAIN CO., LTD., Chiyoda-ku, Tokyo (JP)

(72) Inventor: Takanori Sato, Tokyo (JP)

(73) Assignee: IDEAL BRAIN CO., LTD., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/890,085

(22) PCT Filed: Sep. 25, 2014

(86) PCT No.: PCT/JP2014/004907
§ 371 (c)(1),
(2) Date: Nov. 9, 2015

(87) PCT Pub. No.: WO2015/045384
PCT Pub. Date: Apr. 2, 2015

(65) Prior Publication Data

US 2016/0108613 A1 Apr. 21, 2016

(30) Foreign Application Priority Data

Sep. 25, 2013 (JP) ..... 2013-198379

(51) Int. Cl.
*E04H 9/02* (2006.01)
*E04B 1/98* (2006.01)
(Continued)

(52) U.S. Cl.
CPC ..... *E04B 1/98* (2013.01); *E04B 2/88* (2013.01); *E04H 9/02* (2013.01); *E04H 9/025* (2013.01); *E06B 1/6084* (2013.01); *E04B 2/92* (2013.01)

(58) Field of Classification Search
CPC ..... E04H 9/02; E04H 2009/026; E04H 9/024; E04H 9/021; E04H 9/022; E04B 1/98
(Continued)

(56) References Cited

U.S. PATENT DOCUMENTS 5,732,802 A * 3/1998 Tsukagoshi ..... E04B 1/98 188/378
5,740,652 A * 4/1998 Inoue ..... E04H 9/02 52/167.1
(Continued)

FOREIGN PATENT DOCUMENTS

JP 04047005 U 4/1992
JP 2000073608 A 3/2000
(Continued)

OTHER PUBLICATIONS

International Search Report (ISR) and Written Opinion (WO) dated Nov. 25, 2014 issued in International Application No. PCT/JP2014/004907.

*Primary Examiner* — Rodney Mintz
*Assistant Examiner* — Daniel Kenny
(74) *Attorney, Agent, or Firm* — Holtz, Holtz & Volek PC

(57) ABSTRACT

A vibration control wall structure, which is introducible into a wall part of a building, includes a wall frame, a vibration control wall body, and a vibration control damper for absorbing a vibration acting on a building. The vibration control wall body includes a plurality of face materials which are fixed to a frame material via a fastening member and are connected to each other in a width direction. A gap part is formed such that both side end portions of the vibration control wall body are separated from the wall frame so as to absorb displacement in an in-plane direction. The vibration acting on the building is damped by the vibration control damper having a long hole in a longitudinal width direction of the vibration control wall body. The
(Continued)

vibration control wall body can relatively slide in the long hole in the longitudinal width direction.

18 Claims, 9 Drawing Sheets

(51) Int. Cl.
*E04B 2/88* (2006.01)
*E06B 1/60* (2006.01)
*E04B 2/92* (2006.01)

(58) Field of Classification Search
USPC ..... 52/167.1, 235, 167.8, 204.597, 1, 167.7
See application file for complete search history.

(56) References Cited

U.S. PATENT DOCUMENTS 6,223,483 B1 * 5/2001 Tsukagoshi ..... E04H 9/02 52/167.1
6,457,284 B1 * 10/2002 Isoda ..... E04H 9/02 52/167.1
6,681,536 B1 * 1/2004 Isoda ..... E04H 9/02 52/167.8
8,677,699 B2 * 3/2014 Tagawa ..... E04H 9/021 188/380
8,807,307 B2 * 8/2014 Choi ..... E04H 9/02 188/105
9,163,424 B2 * 10/2015 Montgomery ..... E04H 9/02
2006/0032157 A1 * 2/2006 Baryla ..... E04B 2/7457 52/167.1

FOREIGN PATENT DOCUMENTS

JP 2002309798 A 10/2002
JP 2005307543 A 11/2005
JP 2006161338 A 6/2006
JP 2009243088 A 10/2009
JP 2012077574 A 4/2012

* cited by examiner 3
31
35
34
31e
31d
33
33c
32
31c
33a
31a
33b

VIBRATION CONTROL WALL STRUCTURE

TECHNICAL FIELD

The present invention relates to a vibration control wall structure introduced into a wall part of a building.

BACKGROUND ART

Conventionally, a handrail wall disclosed in Patent Literature 1 which can be reliably installed in a building and reduces an oppressive feeling applied to downstairs has been proposed.

The handrail wall disclosed in Patent Literature 1 is vertically provided on an opening side edge portion of a floor in the building. The handrail wall includes a transparent wall part formed by a transparent plate such as a glass arranged vertically, two wall parts where a height of at least one of the wall parts is set substantially equal to that of the transparent wall part, a coping member provided over an upper end portion of the transparent wall part and an upper end portion of at least one of the wall parts, and a reinforcing frame which holds an upper end portion of the transparent plate and serves as a substrate for mounting the coping member.

CITATION LIST

Patent Literature

Patent Literature 1: JP 2012-77574 A

SUMMARY OF INVENTION

Technical Problems

However, in a case where vibration caused by an earthquake, wind, or the like acts on the building, the upper end portion of the transparent wall part is fixed to an inner side of the coping member by a fixing material so as to press to a cushion material. Accordingly, there is a problem in that the handrail wall disclosed in Patent Literature 1 cannot sufficiently damp vibration.

Further, the handrail wall disclosed in Patent Literature 1 is provided in such a manner that the wall part and the transparent wall part are not separated from each other. Accordingly, displacement of the transparent wall part in an in-plane direction caused by action of vibration on the building is not permitted, and there is a problem in that the transparent wall part may be damaged by stress concentration caused by the vibration.

Therefore, the present invention has been devised in consideration of the aforementioned problems, and an object thereof is to provide a vibration control wall structure capable of damping vibration while absorbing displacement of a vibration control wall body in an in-plane direction even in a case where the vibration caused by an earthquake, wind, or the like acts on a building.

Solution to Problems

According to a first aspect of the present invention, a vibration control wall structure introduced into a wall part of a building, includes: a wall frame provided at the wall part; a vibration control wall body provided at the wall frame; and a vibration control damper provided between the wall frame and the vibration control wall body, wherein in the vibration control wall body, any one of an upper end portion and a lower end portion and both side end portions of a face material are fixed to a frame material, the plurality of face materials is provided inside the wall frame by connecting in a width direction via the frame materials, and a gap part that separates both side portions of the vibration control wall body and the wall frame is formed so as to absorb displacement in an in-plane direction caused when vibration acting on the building is damped by the vibration control damper.

According to a second aspect of the present invention, in the vibration control wall structure according to the first aspect, in the vibration control wall body, when the frame material is mounted to any one or both of a front face portion and a back face portion of the face material with an elastic adhesive material in which a spacer is interposed, any one of the upper end portion and the lower end portion and the both side end portions of the face material are fixed to the frame material.

According to a third aspect of the present invention, in the vibration control wall structure according to the first aspect, in the vibration control wall body, when anyone of the upper end portion and the lower end portion and the both side end portions of the face material are fitted into a fitting part formed at the frame material while an end face of the face material is abutted on an elastic buffer material provided inside the fitting part, any one of the upper end portion and the lower end portion and the both side end portions of the face material are fixed to the frame material.

According to a fourth aspect of the present invention, in the vibration control wall structure according to the first aspect, in the vibration control wall body, when a buffer ring is mounted to a through-hole formed by penetrating from the front face portion to the back face portion of the face material and the frame material is fixed to any one or both of the front face portion and the back face portion of the face material by a fastening member inserted through the through-hole and the buffer ring, any one of the upper end portion and the lower end portion and the both side end portions of the face material are fixed to the frame material.

According to a fifth aspect of the present invention, in the vibration control wall structure of the building according to any one of the first to fourth aspects, in the frame material, an anchor member that fixes any one of an upper end and a lower end of the frame material to the wall frame is provided so as to prevent rising displacement when forces in up and down directions acting from the plurality of adjacent face materials are not balanced between the side end portions of the plurality of adjacent face materials.

According to a sixth aspect of the present invention, in the vibration control wall structure according to any one of the first to fifth aspects, the vibration control damper has a first member mounted to any one or both of the front face portion and the back face portion of the face material and a second member provided by abutting on the first member, and the first member and the second member are slid in a different materials contact state and the vibration control wall body is displaced in the in-plane direction so as to damp vibration acting on the building.

According to a seventh aspect of the present invention, in the vibration control wall structure according to any one of the first to fifth aspects, the vibration control damper has a damping part provided by protruding in the in-plane direction of the vibration control wall body and a support part provided on a side of the damping part, and when the damping part is deformed to damp vibration acting on the building, an abutment portion abutted by the damping part and the support part is set so as to be inclined at a predetermined angle by abutting the damping part on the support part in such a manner that the damping part can be deformed in a state in which predetermined vibrating damping performance is maintained.

Advantageous Effects of Invention

According to the first to seventh aspects of the present invention, at the gap part that is formed by separating the both side portions of the vibration control wall body in the width direction and the wall frame, the vibration control wall body that integrates the plurality of face materials is displaced, and the displacement of the vibration control wall body in the in-plane direction caused when the vibration acting on the building is damped by the vibration control damper is absorbed. With this configuration, according to the first to seventh aspects of the present invention, the vibration control wall body that integrates the plurality of face materials is displaced in a state in which the plurality of face materials is fixed to the frame material, and the displacement of the vibration control wall body in the in-plane direction can be reliably absorbed while the vibration acting on the building is damped by the vibration control damper.

According to the first to seventh aspects of the present invention, since the respective small and light face materials are easily transported and the plurality of face materials reliably connected in a lateral direction of the building is installed, the integrated vibration control wall body to which the vibration damping performance is applied can be easily constructed in the building. According to the first to seventh aspects of the present invention, since the integrated vibration control wall body to which the vibration damping performance is applied can be easily constructed, a vibration control function can be introduced to the wall part of the building in a short construction period and at a low cost.

Particularly, in the second aspect of the present invention, since the frame material is mounted to the face material with the elastic adhesive material in which the spacer is interposed, the frame material can be separated from the face material at a predetermined interval. Accordingly, in a case where vibration caused by an earthquake, wind, or the like acts on the building, relative displacement between the face material and the frame material is absorbed by the elastic adhesive material in which the spacer is interposed and which is provided separately at the predetermined interval, and the vibration acting on the building can be damped.

Particularly, in the third aspect of the present invention, since the elastic buffer material, such as rubber, is provided inside the fitting part formed at the frame material, the end face of the face material is not directly brought into contact with the frame material. Accordingly, in a case where vibration caused by an earthquake, wind, or the like acts on the building, relative displacement between the face material and the frame material is absorbed by the elastic buffer material of the frame material, and the vibration acting on the building can be damped.

Particularly, in the fourth aspect of the present invention, since the substantially cylindrical buffer ring is mounted to the inside of the through-hole of the face material, the buffer ring is provided as a buffer material between the through-hole of the face material and the fastening member, and the fastening member is not directly brought into contact with the face material. Accordingly, in a case where vibration caused by an earthquake, wind, or the like acts on the building, relative displacement between the face material and the frame material is absorbed by the buffer ring of the face material, and the vibration acting on the building can be damped.

Particularly, in the fifth aspect of the present invention, since the anchor member is provided at the frame material so as to prevent the frame material from inclining and displacing in the width direction between the plurality of adjacent face materials, looseness or deformation of the frame material caused by the vibration can be prevented. Accordingly, in a case where vibration caused by an earthquake, wind, or the like acts on the building, the plurality of adjacent face materials is reliably integrated, and the vibration control wall body can be firmly fixed at the lower end portions or the upper end portions of the plurality of face materials.

Particularly, in the sixth aspect of the present invention, when the first member and the second member slide in the different materials contact state, aluminum or the like is partially dissolved into an iron plate, a steel plate, or the like between the iron plate, the steel plate, or the like and an aluminum plate or the like. Moreover, the respective metal particles are integrated, and an area where the metals flow is formed without forming an interface. Accordingly, a significantly high coefficient of friction can be obtained as compared to frictional resistance that forms the interface, absorption performance against vibration acting on the building is significantly improved, and collapse of the building or falling of the face material can be reliably prevented. According to the sixth aspect of the present invention, a long hole where the width direction of the vibration control wall body becomes a longitudinal direction is formed at the second member, and the fastening member is inserted through this long hole. Accordingly, when the first member and the second member relatively slide in the long hole in the width direction of the vibration control wall body, the vibration acting on the building can be absorbed by friction damping.

Particularly, in the seventh aspect of the present invention, a tip end portion and a base end portion of the damping part are displaced in the width direction in a relatively stable manner, and the damping part is deformed in a state in which the predetermined vibration damping performance is maintained. Accordingly, the vibration acting on the building is efficiently absorbed by the vibration control damper, and collapse of the building or falling of the face material can be reliably prevented.

DESCRIPTION OF EMBODIMENTS

Hereinafter, embodiments for carrying out a vibration control wall structure 1 to which the present invention is applied will be described with reference to the drawings.

Figure 1:
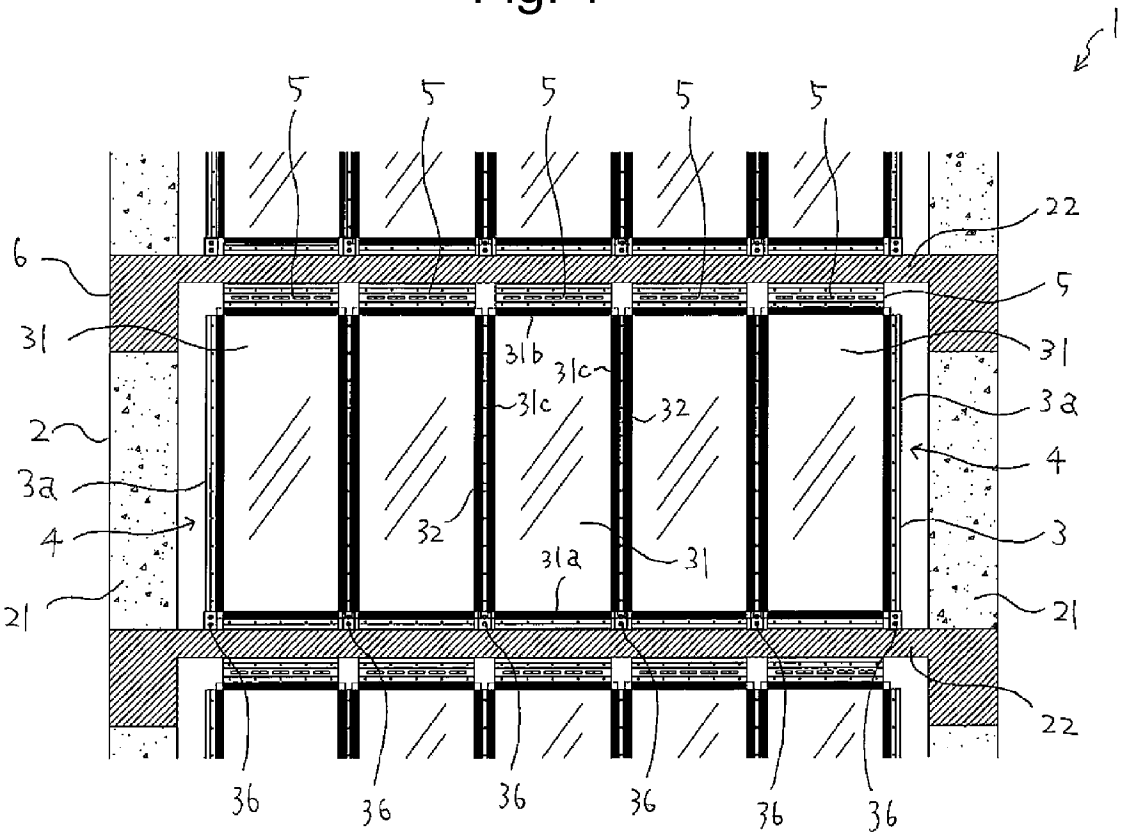
FIG. 1 is a front view that illustrates a vibration control wall structure to which the present invention is applied.

As illustrated in FIG. 1, the vibration control wall structure 1 to which the present invention is applied is introduced into a wall part 6 of a building. The vibration control wall structure 1 includes a wall frame 2 provided at the wall part 6, a vibration control wall body 3 provided at the wall frame 2, and a vibration control damper 5 provided between the wall frame 2 and the vibration control wall body 3.

The wall frame 2 is constructed as a structural member or the like which forms the basis for structural yield strength of the building. The wall frame 2 includes, for example, a plurality of column materials 21 provided separately at predetermined intervals in a lateral direction of the building and a plurality of beam materials 22 provided separately at predetermined intervals in a longitudinal direction of the building. The plurality of column materials 21 and the plurality of beam materials 22 are combined in such a manner that the wall part 6 of the building is opened in a substantially rectangular shape.

The vibration control wall body 3 is constructed, for example, as a glass-walled curtain wall that does not bear the structural yield strength of the building. The vibration control wall body 3 is not limited to this, and may be constructed as a structural member or the like which forms the basis for the structural yield strength of the building. The vibration control wall body 3 is provided inside the wall frame 2 opened in the substantially rectangular shape by connecting a plurality of face materials 31 in a width direction of the vibration control wall body 3 in such a manner that the lateral direction of the building becomes the width direction.

A plurality of substantially rectangular glasses, steel plates, or shutters is used for the face material 31. When a lower end portion 31*a* and both side end portions 31*c* are fixed by a frame material 32 of the vibration control wall body 3, the face material 31 is connected with adjacent face materials 31 in the width direction of the vibration control wall body 3. The face material 31 is not limited to this, and three sides, i.e., an upper end portion 31*b* and the both side end portions 31*c*, may be fixed by the frame material 32 of the vibration control wall body 3.

The frame material 32 connects the plurality of face materials 31 with a predetermined fixing strength $Q_{FIX}$. In a case where vibration caused by an earthquake, wind, or the like acts on the building, the frame material 32 suppresses relative displacement in such a manner that the adjacent face materials 31 are not separated from each other. The frame material 32 connects the adjacent face materials 31 between the plurality of adjacent face materials 31 with the predetermined fixing strength $Q_{FIX}$ and the vibration control wall body 3, which is made by integrating the plurality of face materials 31, is constructed.

Figures 2A, 2B:
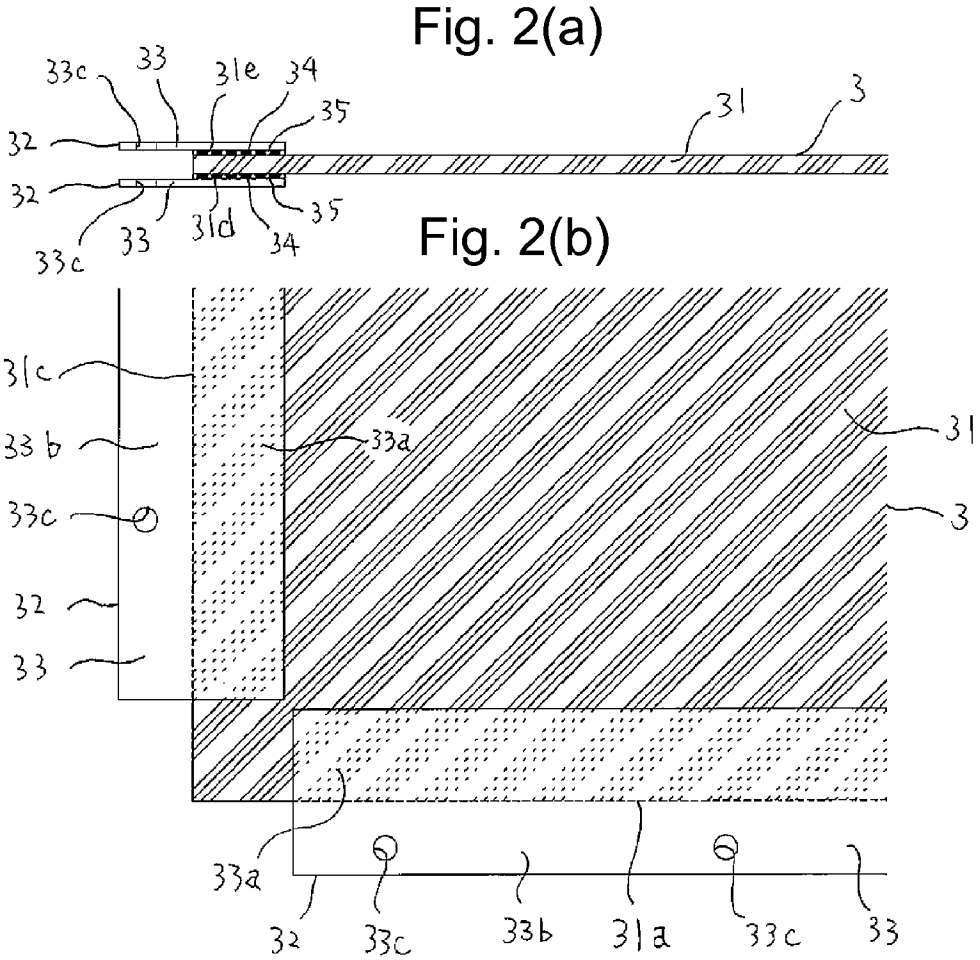
FIG. 2(*a*) is a partial enlarged plan view that illustrates a vibration control wall body according to a first embodiment of the vibration control wall structure to which the present invention is applied, and FIG. 2(*b*) is a partial enlarged front view of the vibration control wall body.

As illustrated in FIGS. 2(*a*) and 2(*b*), in the vibration control wall body 3 according to a first embodiment, at the both side end portions 31*c*, the lower end portion 31*a*, or the upper end portion 31*b* of the face material 31, a metal band plate 33 is mounted as the frame material 32 to any one or both of a front face portion 31*d* disposed inside the building and a back face portion 31*e* disposed outside the building.

A substantially band-shaped plate material formed by extending along a peripheral edge of the face material 31 is used for the metal band plate 33. When the metal band plate 33 is mounted to the front face portion 31*d* and the back face portion 31*e* of the face material 31, a pair of metal band plates 33 is provided on the face material 31. The metal band plate 33 has a mounting portion 33*a* mounted to the face material 31 and a connection portion 33*b* that extends from the mounting portion 33*a* in an in-plane direction of the face material 31. A plurality of connection hole portions 33*c* is formed on the connection portion 33*b*.

When the front face portion 31*d* and the back face portion 31*e* of the face material 31 and the mounting portion 33*a* of the metal band plate 33 are adhered to each other with an elastic adhesive material 34, such as a silicon sealant or a double-sided tape made of silicon, the metal band plate 33 is fixed by drying and solidification or the like of the elastic adhesive material 34. Since a spacer 35, such as a glass sphere, is mixed into the elastic adhesive material 34, the elastic adhesive material 34 in which the spacer 35 is interposed is applied between the face material 31 and the metal band plate 33, and the metal band plate 33 is fixed in a state of being separated from the face material 31 by approximately 1 to 3 mm.

A bolt or the like is inserted through the connection hole portion 33*c* formed at the connection portion 33*b*. When this bolt or the like is fastened by a nut or the like, the metal band plate 33 is fixed to the metal band plate 33 of the adjacent face material 31 or the beam material 22 of the wall frame 2 via the steel plate or the like, and the plurality of face materials 31 is integrally provided.

In the vibration control wall body 3 in the first embodiment, since the frame material 32 is mounted to the face material 31 with the elastic adhesive material 34 in which the spacer 35 is interposed, the metal band plate 33 can be separated from the face material 31 at a predetermined interval. With this configuration, in the vibration control wall structure 1 to which the present invention is applied, in a case where vibration caused by an earthquake, wind, or the like acts on the building, relative displacement between the face material 31 and the metal band plate 33 is absorbed by the elastic adhesive material 34 in which the spacer 35 is interposed and which is provided separately at the predetermined interval, and the vibration acting on the building can be damped.

Figure 3A:
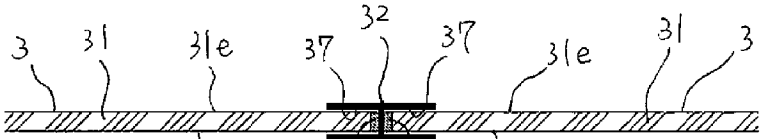
FIG. 3(*a*) is a partial enlarged plan view that illustrates a vibration control wall body according to a second embodiment of the vibration control wall structure to which the present invention is applied, and FIG. 3(*b*) is a partial enlarged front view of the vibration control wall body.
Figure 3B:
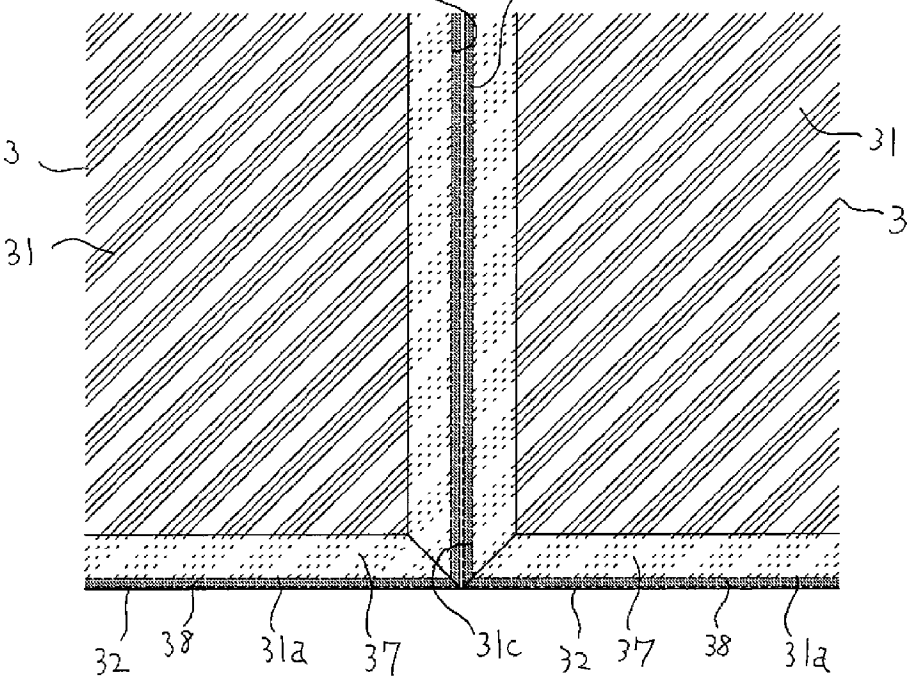

As illustrated in FIGS. 3(*a*) and 3(*b*), in the vibration control wall body 3 in a second embodiment, a fitting part 37, into which both side end portions 31*c*, a lower end portion 31*a*, or an upper end portion 31*b* of a face material 31 is/are fitted, is formed at a frame material 32. In the vibration control wall body 3, the both side end portions 31*c*, the lower end portion 31*a*, or the upper end portion 31*b* of the face material 31 is/are fixed to the frame material 32 by fitting into the fitting part 37 formed at the frame material 32, and the plurality of face materials 31 is integrated in a width direction.

The fitting part 37 is formed at the frame material 32 so as to hold a front face portion 31*d* and a back face portion 31*e* of the face material 31. In the frame material 32, an elastic buffer material 38, such as rubber, is provided inside the fitting part 37. The both side end portions 31*c*, the lower end portion 31*a*, or the upper end portion 31*b* of the face material 31 is/are fixed while causing the elastic buffer material 38 to abut on an end face of the face material 31.

In the vibration control wall body 3 in the second embodiment, since the elastic buffer material 38, such as rubber, is provided inside the fitting part 37 formed at the frame material 32, the end face of the face material 31 is not directly brought into contact with the frame material 32. With this configuration, in the vibration control wall structure 1 to which the present invention is applied, in a case where vibration caused by an earthquake, wind, or the like acts on the building, relative displacement between the face material 31 and the frame material 32 is absorbed by the elastic buffer material 38 of the frame material 32, and the vibration acting on the building can be damped.

Figures 4A, 4B:
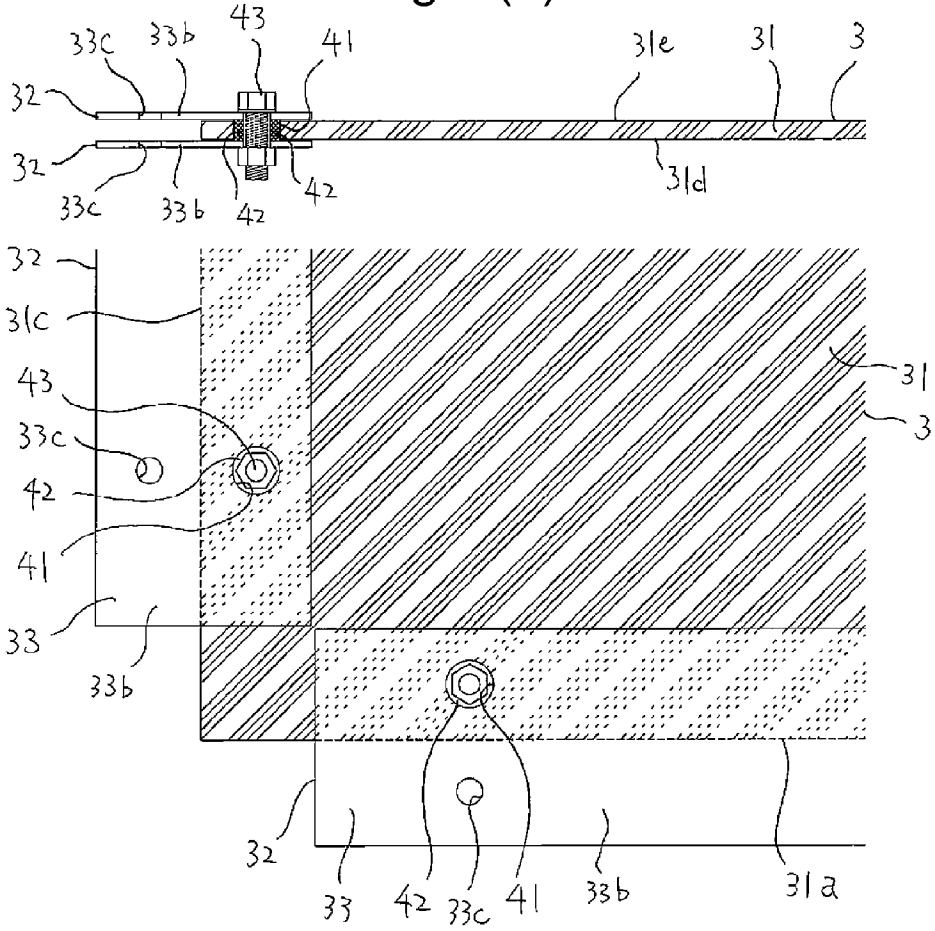
FIG. 4(*a*) is a partial enlarged plan view that illustrates a vibration control wall body according to a third embodiment of the vibration control wall structure to which the present invention is applied, and FIG. 4(*b*) is a partial enlarged front view of the vibration control wall body.

As illustrated in FIGS. 4(*a*) and 4(*b*), in the vibration control wall body 3 in a third embodiment, a buffer ring 42 formed slightly thicker than a face material 31 is mounted to an inside of a through-hole 41 formed by penetrating from a front face portion 31*d* to a back face portion 31*e* of the face material 31. In the vibration control wall body 3, the buffer ring 42 made of lead or the like is used, and a frame material 32 is fixed to any one or both of the front face portion 31*d* and the back face portion 31*e* of the face material 31 by a fastening member 43 inserted through the through-hole 41 and the buffer ring 42. In the vibration control wall body 3, both side end portions 31*c*, a lower end portion 31*a*, or an upper end portion 31*b* of the face material 31 is/are fixed to the frame material 32, and the plurality of face materials 31 is integrated in a width direction.

In the frame material 32, a metal band plate 33 is used at any one or both of the front face portion 31*d* and the back face portion 31*e* of the face material 31. The frame material 32 is fixed to the metal band plates 33 of the adjacent face materials 31 or the beam material 22 of the wall frame 2 by using a bolt or the like for a connection portion 33*b* of the metal band plate 33. In the frame material 32, the plurality of face materials 31 is integrated at the metal band plates 33, and the vibration control wall body 3 is fixed to the beam material 22 at the lower end portions 31*a* or the upper end portions 31*b* of the plurality of face materials 31.

In the vibration control wall body 3 in the third embodiment, since the substantially cylindrical buffer ring 42 is mounted to the inside of the through-hole 41 of the face material 31, the buffer ring 42 is provided as a buffer material between the through-hole 41 of the face material 31 and the fastening member 43, and the fastening member 43 is not directly brought into contact with the face material 31. With this configuration, in the vibration control wall structure 1 to which the present invention is applied, in a case where vibration caused by an earthquake, wind, or the like acts on the building, relative displacement between the face material 31 and the frame material 32 is absorbed by the buffer ring 42 of the face material 31, and the vibration acting on the building can be damped.

As illustrated in FIG. 1, in any of the first to third embodiments, an anchor member 36 for fixing any one of an upper end and a lower end of the frame material 32 to the beam material 22 of the wall frame 2 is provided in the vibration control wall body 3 as necessary. At this time, the anchor member 36 is provided by embedding in the upper beam material 22 or the lower beam material 22 or the like.

In the vibration control wall body 3 in any of the first to third embodiments, when the vibration caused by an earthquake, wind, or the like acts on the building, since the face materials 31 adjacent to each other in the width direction of the vibration control wall body 3 relatively move in up and down directions, shearing forces with different sizes in the width direction act on the frame material 32 from the adjacent face materials 31. At this time, the shearing forces with different sizes act on both sides of the frame material 32 in the width direction and the frame material 32 is inclined in the width direction thereof. In the frame material 32, when the forces in the up and down directions acting from the plurality of adjacent face materials 31 are not balanced between the side end portions of the plurality of adjacent face materials 31, displacement that the frame material 32 separates and rises from the beam material 22 of the wall frame 2 occurs. In order to prevent this rising displacement, the frame material 32 is fixed by the anchor member 36.

In the frame material 32, the anchor member 36 is provided so as to prevent the rising displacement when the forces in the up and down directions acting from the plurality of adjacent face materials 31 are not balanced between the side end portions of the plurality of adjacent face materials 31. Accordingly, looseness or deformation of the frame material 32 caused by the vibration can be prevented. With this configuration, in the vibration control wall structure 1 to which the present invention is applied, in a case where vibration caused by an earthquake, wind, or the like acts on the building, the plurality of adjacent face materials 31 is reliably integrated, and the vibration control wall body 3 can be firmly fixed at the lower end portions 31*a* or the upper end portions 31*b* of the plurality of face materials 31.

As illustrated in FIG. 1, the vibration control damper 5 is provided between the wall frame 2 and the vibration control wall body 3 at the lower end portion 31*a* or the upper end portion 31*b* of the face material 31 that is not fixed to the beam material 22 by the frame material 32.

Figure 5B:
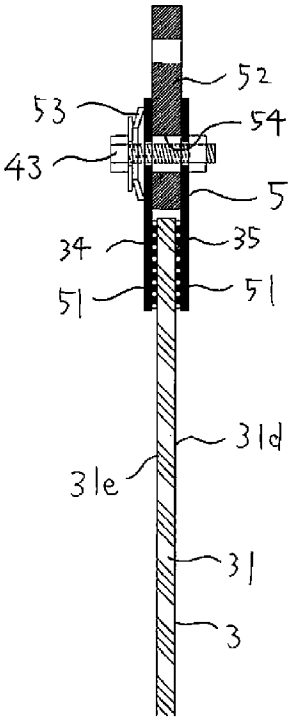
FIG. 5(*a*) is a partial enlarged front view that illustrates a vibration control damper according to the first embodiment of the vibration control wall structure to which the present invention is applied, and FIG. 5(*b*) is a partial enlarged side view of the vibration control damper.
Figure 5A:
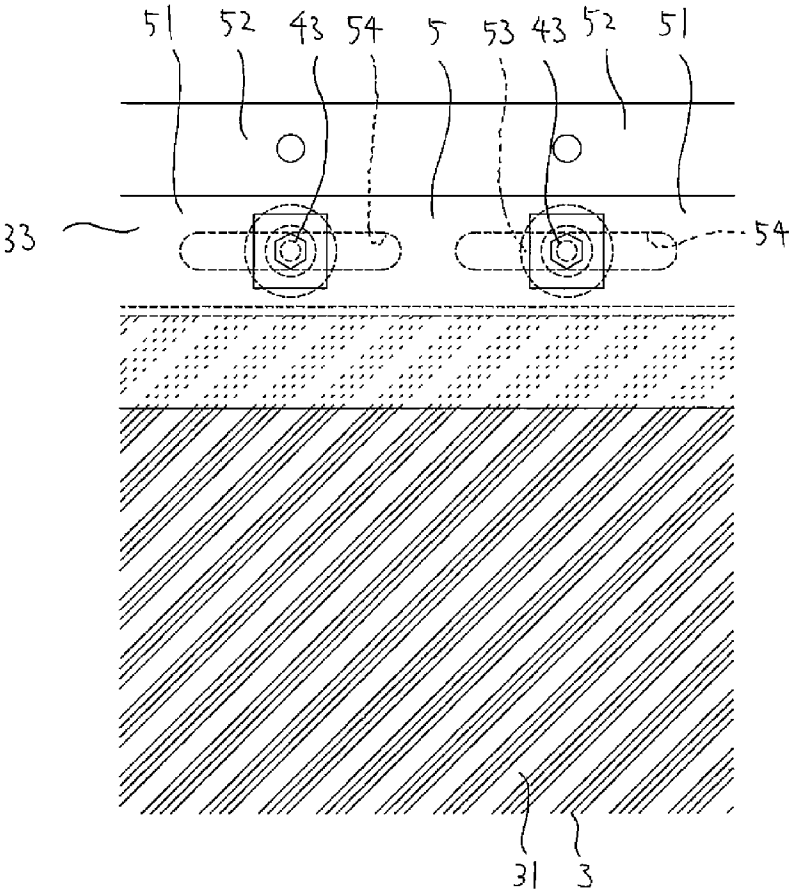

As illustrated in FIGS. 5(*a*) and 5(*b*), in the first embodiment, the vibration control damper 5 includes a first member 51 mounted to any one or both of the front face portion 31*d* and the back face portion 31*e* of the face material 31 of the vibration control wall body 3 and a second member 52 provided by abutting on the first member 51 in a state in which the second member 52 is sandwiched by the first member 51.

An iron plate, a steel plate, the metal band plate 33, or the like is used for the first member 51. The first member 51 is mounted to any one or both of the front face portion 31*d* and the back face portion 31*e* of the face material 31 of the vibration control wall body 3 with the elastic adhesive material 34 or the like in which the spacer 35 is interposed. An aluminum plate, a stainless plate, a brass plate, a resin plate, or the like is used for the second member 52. An upper end or a lower end of the second member 52 is fixed to the upper beam material 22 or the lower beam material 22.

The first member 51 and the second member 52 are fixed by the fastening member 43 in a state in which a disc spring 53 is interposed on the front face side or the back face side of the face material 31. Accordingly, in order to damp vibration acting on the building, the first member 51 and the second member 52 are slid in a different materials contact state, and the vibration control wall body 3 is displaced in the in-plane direction.

Here, "the different materials contact state" means a different metals contact state where an iron material or a steel material is in contact with aluminum, a different metals contact state where the iron material or the steel material is in contact with brass, a different metals contact state where the iron material or the steel material is in contact with stainless, a different materials contact state where the iron material or the steel material is in contact with a resin containing metal powders, a different materials contact state where the iron material or the steel material is in contact with a resin without containing metal powders, or the like.

In the vibration control damper 5, a long hole 54 where the width direction of the vibration control wall body 3 becomes a longitudinal direction is formed at the second member 52, and the fastening member 43 is inserted through this long hole 54. In the first embodiment, when the first member 51 and the second member 52 relatively slide in the long hole 54 in the width direction of the vibration control wall body 3, the vibration control damper 5 can absorb the vibration acting on the building by friction damping.

Figure 6B:
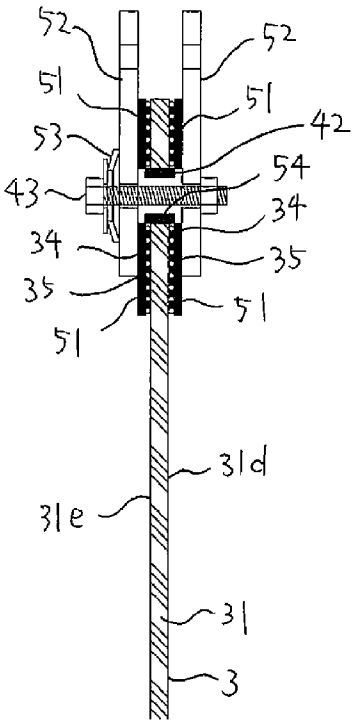
FIG. 6(*a*) is a partial enlarged front view that illustrates a vibration control damper according to the second embodiment of the vibration control wall structure to which the present invention is applied, and FIG. 6(*b*) is a partial enlarged side view of the vibration control damper.
Figure 6A:
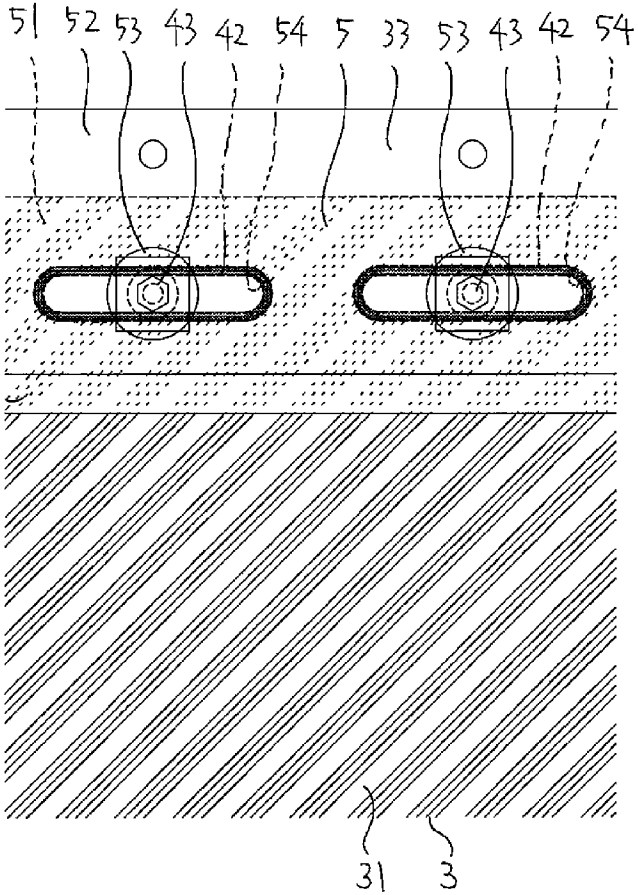

As illustrated in FIGS. 6(*a*) and 6(*b*), in the second embodiment, the vibration control damper 5 includes a first member 51 mounted to any one or both of the front face portion 31*d* and the back face portion 31*e* of the face material 31 of the vibration control wall body 3 and a second member 52 provided by abutting on the first member 51 in a state in which the first member 51 is sandwiched.

An aluminum plate, a stainless plate, a brass plate, a resin plate, or the like is used for the first member 51. The first member 51 is mounted to any one or both of the front face portion 31*d* and the back face portion 31*e* of the face material 31 of the vibration control wall body 3 with the elastic adhesive material 34 or the like in which the spacer 35 is interposed. An iron plate, a steel plate, the metal band plate 33, or the like is used for the second member 52. An upper end or a lower end of the second member 52 is fixed to the upper beam material 22 or the lower beam material 22.

The first member 51 and the second member 52 are fixed by the fastening member 43 in a state in which a disc spring 53 is interposed on the front face side or the back face side of the face material 31. Accordingly, in order to damp vibration acting on the building, the first member 51 and the second member 52 are slid in a different materials contact state, and the vibration control wall body 3 is displaced in an in-plane direction.

In the vibration control damper 5, a long hole 54 where the width direction of the vibration control wall body 3 becomes a longitudinal direction is formed at the second member 52, and the fastening member 43 is inserted through the long hole 54 in a state in which the buffer ring 42 is mounted to an inside of the long hole 54. In the second embodiment as well, when the first member 51 and the second member 52 relatively slide in the long hole 54 in the width direction of the vibration control wall body 3, the vibration control damper 5 can absorb the vibration acting on the building by friction damping.

In the vibration control damper 5 in the first and second embodiments, smoothness of the substantially flat first member 51 or second member 52 is improved. Accordingly, when the first member 51 and the second member 52 slide in the different materials contact state, the aluminum or the like is partially dissolved into the iron plate, the steel plate, or the like between the iron plate, the steel plate, or the like and the aluminum plate or the like. Moreover, the respective metal particles are integrated, and an area where the metals flow is formed without forming an interface. With this configuration, in the vibration control wall structure 1 to which the present invention is applied, a significantly high coefficient of friction can be obtained as compared to frictional resistance that forms the interface, absorption performance against vibration acting on the building is significantly improved, and collapse of the building or falling of the face material 31 can be reliably prevented.

Figure 7B:
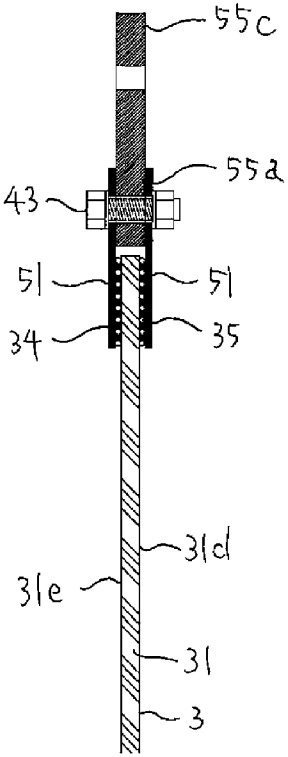
FIG. 7(*a*) is a partial enlarged front view that illustrates a vibration control damper according to the third embodiment of the vibration control wall structure to which the present invention is applied, and FIG. 7(*b*) is a partial enlarged side view of the vibration control damper.
Figure 7A:
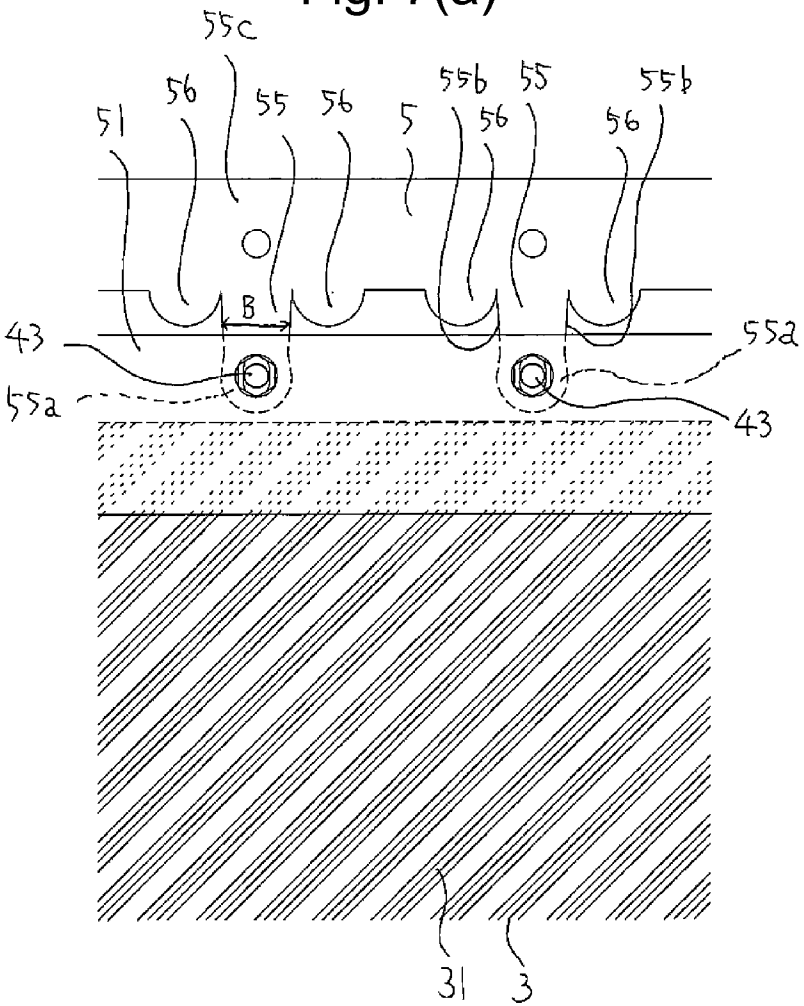

As illustrated in FIGS. 7(*a*) and 7(*b*), in the third embodiment, the vibration control damper 5 has a damping part 55 provided by protruding in an in-plane direction of the vibration control wall body 3 and a pair of support parts 56 provided on sides of the damping part 55.

In the damping part 55, a base end portion 55*c* is fixed to the upper beam material 22 or the lower beam material 22, and in a state in which the damping part 55 is sandwiched by a first member 51 mounted to any one or both of the front face portion 31*d* and the back face portion 31*e* of the face material 31 of the vibration control wall body 3, a tip end portion 55*a* is fixed to the first member 51 by the fastening member 43. When vibration caused by an earthquake, wind, or the like acts on the building and the vibration control wall body 3 is displaced in the in-plane direction, the damping part 55 is deformed while inclining in the width direction and causing an abutment portion 55*b* to abut on the support part 56.

In the damping part 55, a width B of the damping part 55 is set in such a manner that a moment proof stress Mp calculated from a plate thickness t of the damping part 55 and a yield point strength $\sigma_y$ of the steel material lowers, as a deformation amount of the tip end portion 55*a* in the width direction of the vibration control wall body 3 becomes large. It should be noted that the moment proof stress Mp is calculated by $Mp=t\times B^2/4\times\sigma_y$. The width B of the damping part 55 is set in such a manner that the moment proof stress Mp lowers as the vibration control wall body 3 is separated from the base end portion 55*c* in a height direction of the damping part 55. Accordingly, the abutment portion 55*b* of the damping part 55 is set so as to incline at a predetermined angle.

In the vibration control damper 5, the support part 56 and the abutment portion 55*b* of the damping part 55 are set so as to incline at the predetermined angle. Accordingly, the moment proof stress Mp of the damping part 55 can be lowered, a stable displacement amount of the tip end portion 55*a* of the damping part 55 is secured while making a load Q caused by the vibration acting on the building bilinear, and the damping part 55 can be deformed in a state in which predetermined vibration damping performance is maintained.

Figure 8B:
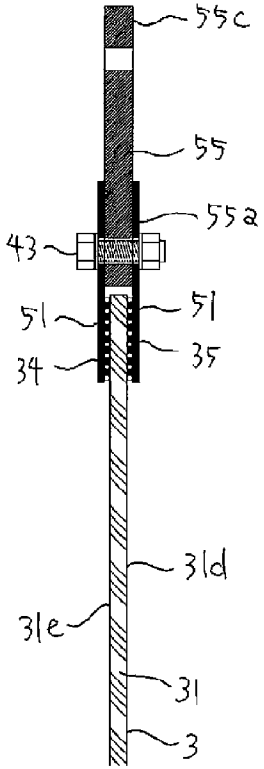
FIG. 8(*a*) is a partial enlarged front view that illustrates a vibration control damper according to a fourth embodiment of the vibration control wall structure to which the present invention is applied, and FIG. 8(*b*) is a partial enlarged side view of the vibration control damper.
Figure 8A:
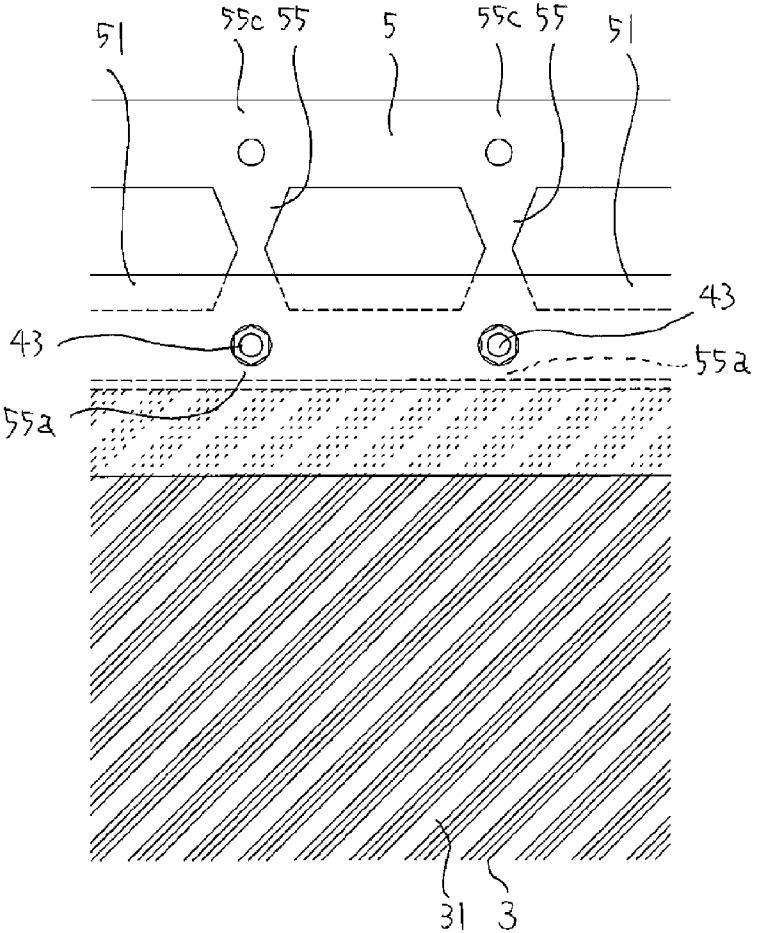

As illustrated in FIGS. 8(*a*) and 8(*b*), in a fourth embodiment, the vibration control damper 5 has a damping part 55 provided by protruding in an in-plane direction of the vibration control wall body 3.

In the damping part 55, a base end portion 55*c* is fixed to the upper beam material 22 or the lower beam material 22, and in a state in which the damping part 55 is sandwiched by a first member 51 mounted to any one or both of a front face portion 31*d* and a back face portion 31*e* of the face material 31 of the vibration control wall body 3, a tip end portion 55*a* is fixed to the first member 51 by a fastening member 43. When vibration caused by an earthquake, wind, or the like acts on the building and the vibration control wall body 3 is displaced in an in-plane direction, the damping part 55 is deformed while inclining in the width direction.

In the damping part 55, a width B of the damping part 55 is set in such a manner that a moment proof stress Mp calculated from a plate thickness t of the damping part 55 and a yield point strength $\sigma_y$ of the steel material lowers, as a deformation amount of the tip end portion 55*a* in the width direction of the vibration control wall body 3 becomes large. It should be noted that the moment proof stress Mp is calculated by $Mp=t\times B^2/4\times\sigma_y$. The width B of the damping part 55 is set so as to be different in a height direction of the damping part 55 in such a manner that the moment proof stress Mp lowers as the vibration control wall body 3 is separated from the tip end portion 55*a* and the base end portion 55*c* in the height direction.

In the vibration control damper 5, the width B of the damping part 55 is set so as to be different in the height direction. Accordingly, the moment proof stress Mp of the damping part 55 can be lowered, a stable displacement amount of the tip end portion 55*a* of the damping part 55 is secured while making a load Q caused by the vibration acting on the building bilinear, and the damping part 55 can be deformed in a state in which predetermined vibration damping performance is maintained.

In the vibration control damper 5 in the third and fourth embodiments, the tip end portion 55*a* and the base end portion 55*c* of the damping part 55 are displaced in the width direction in a relatively stable manner, and the damping part 55 is deformed in a state in which the predetermined vibration damping performance is maintained. With this configuration, in the vibration control wall structure 1 to which the present invention is applied, the vibration acting on the building is efficiently absorbed by the vibration control damper 5, and collapse of the building or falling of the face material 31 can be reliably prevented.

Figure 9B:
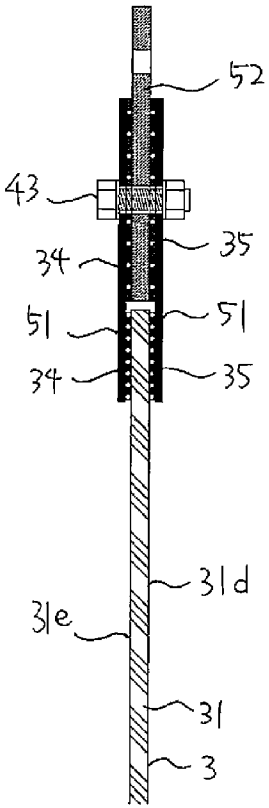
FIG. 9(*a*) is a partial enlarged front view that illustrates a vibration control damper according to a fifth embodiment of the vibration control wall structure to which the present invention is applied, and FIG. 9(*b*) is a partial enlarged side view of the vibration control damper.
Figure 9A:
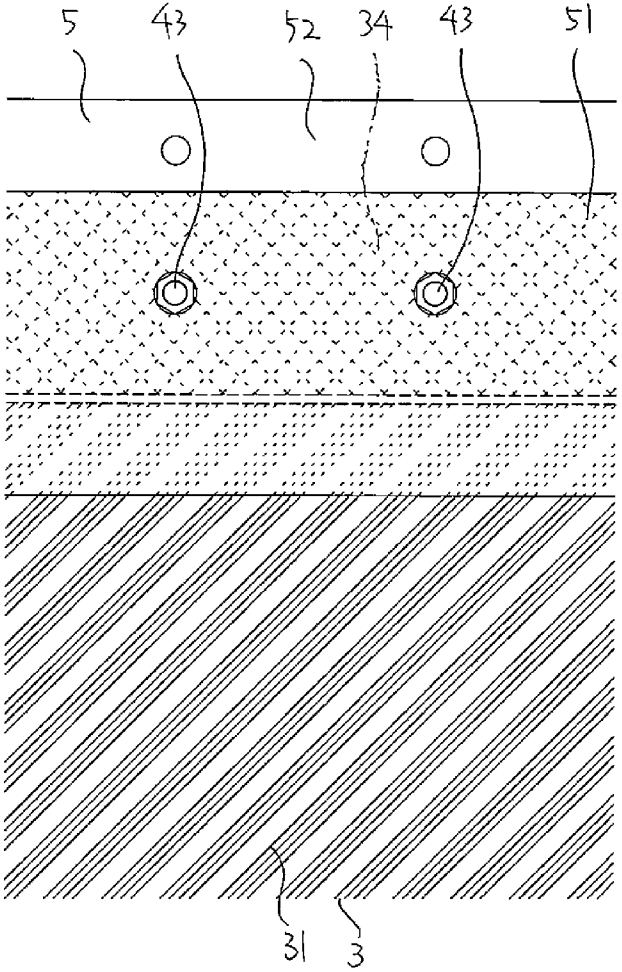

As illustrated in FIGS. 9(*a*) and 9(*b*), in a fifth embodiment, the vibration control damper 5 includes a first member 51, which is mounted to any one or both of a front face portion 31*d* and a back face portion 31*e* of the face material 31, and a second member 52, which is mounted to the first member 51 with an elastic adhesive material 34 in which a spacer 35 is interposed.

The first member 51 is mounted to any one or both of the front face portion 31*d* and the back face portion 31*e* of the face material 31 of the vibration control wall body 3 with the elastic adhesive material 34 in which the spacer 35 is interposed. An upper end or a lower end of the second member 52 is fixed to the upper beam material 22 or the lower beam material 22, and the second member 52 is fixed by the fastening member 43 in a state in which the second member 52 is sandwiched by the first member 51.

In the vibration control wall body 3 in the fifth embodiment, since the second member 52 is mounted to the first member 51 by using the elastic adhesive material 34 in which the spacer 35 is interposed, the second member 52 can be separated from the first member 51 at a predetermined interval. With this configuration, in the vibration control wall structure 1 to which the present invention is applied, in a case where vibration caused by an earthquake, wind, or the like acts on the building, relative displacement between the first member 51 and the second member 52 is absorbed by the elastic adhesive material 34 in which the spacer 35 is interposed and which is provided separately at the predetermined interval, and the vibration acting on the building can be damped.

As illustrated in FIG. 1, in the vibration control wall structure 1 to which the present invention is applied, a yield strength $Q_y$ when the vibration control damper 5 is displaced by the vibration acting on the building is smaller than the fixing strength $Q_{FIX}$ of the face material 31 caused by the frame material 32. With this configuration, in the vibration control wall structure 1 to which the present invention is applied, the vibration control wall body 3 that integrates the plurality of face materials 31 is displaced in a state in which the plurality of face materials 31 is fixed to the frame materials 32, and the vibration acting on the building can be reliably damped by the vibration control damper 5.

In the vibration control wall structure 1 to which the present invention is applied, a gap part 4 is formed by separating both side portions 3*a* of the vibration control wall body 3 in the width direction and the column material 21 of the wall frame 2. In the vibration control wall structure 1 to which the present invention is applied, at the gap part 4, the vibration control wall body 3 that integrates the plurality of face materials 31 is displaced, and the displacement of the vibration control wall body 3 in the in-plane direction caused when the vibration acting on the building is damped by the vibration control damper 5 is absorbed. With this configuration, in the vibration control wall structure 1 to which the present invention is applied, the vibration control wall body 3 that integrates the plurality of face materials 31 is displaced in a state in which the plurality of face materials 31 is fixed to the frame material 32, and the displacement of the vibration control wall body 3 in the in-plane direction can be reliably absorbed while the vibration acting on the building is damped by the vibration control damper 5.

In the vibration control wall structure 1 to which the present invention is applied, the respective small and light face materials 31 are easily transported, and the plurality of face materials 31 reliably connected in a lateral direction of the building is installed. Accordingly, the integrated vibration control wall body 3 to which the vibration damping performance is applied can be easily constructed in the building. In the vibration control wall structure 1 to which the present invention is applied, since the integrated vibration control wall body 3 to which the vibration damping performance is applied can be easily constructed, a vibration control function can be introduced to the wall part 6 of the building in a short construction period and at a low cost.

Hereinabove, the embodiments of the present invention have been described in detail. However, any of the aforementioned embodiments merely illustrate concrete examples in implementing the present invention. A technical scope of the present invention shall not be interpreted in a limited manner by these embodiments.

REFERENCE SIGNS LIST

1: vibration control wall structure
2: wall frame
21: column material
22: beam material
3: vibration control wall body
3*a*: both side portions
31: face material
31*a*: lower end portion
31*b*: upper end portion
31*c*: both side end portions
31*d*: front face portion

31*e*: back face portion
32: frame material
33: metal band plate
33*a*: mounting portion
33*b*: connection portion
33*c*: connection hole portion
34: elastic adhesive material
35: spacer
36: anchor member
37: fitting part
38: elastic buffer material
4: gap part
41: through-hole
42: buffer ring
43: fastening member
5: vibration control damper
51: first member
52: second member
53: disc spring
54: long hole
55: damping part
55*a*: tip end portion
55*b*: abutment portion
55*c*: base end portion
56: support part
6: wall part

The invention claimed is:

1. A vibration control wall structure comprising:

a wall part of a building including a wall frame;

a vibration control wall body provided inside the wall frame; and a vibration control damper provided between a portion of the wall frame and the vibration control wall body, the vibration control damper comprising an elongated hole in a longitudinal width direction of the vibration control wall body, wherein in the vibration control wall body any one of an upper end portion and a lower end portion and both side end portions of a glass face material are fixed to a frame material, a plurality of the face materials are provided inside the wall frame by connecting the framed face materials to each other in a width direction via the frame material, a gap part is formed such that both side end portions of the vibration control wall body are separated from the wall frame so as to absorb displacement in an in-plane direction caused when vibration acting on the building is damped by the vibration control damper, and the frame material is fixed to the face material and the wall frame via a fastening member, and wherein in the vibration control damper, the fastening member is inserted through the elongated hole so that the vibration control wall body relatively slides in the elongated hole in the longitudinal width direction of the vibration control wall body, such that the vibration control damper absorbs a vibration acting on the building by friction damping.

2. The vibration control wall structure according to claim 1, wherein in the vibration control wall body, any one of the upper end portion and the lower end portion and both side end portions of the face material are fixed to the frame material by at least one of a front face portion and a back face portion of the face material with an elastic adhesive material in which a spacer is interposed.

3. The vibration control wall structure according to claim 2, further comprising an anchor member that fixes any one of an upper end and a lower end of the frame material to the wall frame so as to prevent rising displacement when forces in up and down directions acting from the plurality of adjacent face materials are not balanced between the side end portions of the plurality of adjacent face materials.

4. The vibration control wall structure according to claim 2, wherein the vibration control damper has a first member mounted on at least one of a front face portion and a back face portion of the face material and a second member abutting on the first member, and wherein the first member slides on a first material in contact with a different material on which the second member slides, such that the vibration control wall body is displaced in the in-plane direction so as to damp vibration acting on the building.

5. The vibration control wall structure according to claim 2, wherein the vibration control damper comprises a damping part protruding in the in-plane direction of the vibration control wall body and a support part provided on a side of the damping part, and wherein when the damping part is deformed to damp vibration acting on a building, an abutment portion abutted by the damping part and the support part is set so as to be inclined at a predetermined angle by abutting the damping part on the support part so that the damping part can be deformed in a state in which predetermined vibrating damping performance is maintained.

6. The vibration control wall structure according to claim 1, wherein in the vibration control wall body, any one of the upper end portion and the lower end portion and both side end portions of the face material are fixed to the frame material by fitting into a fitting part formed at the frame material while an end face of the face material is abutted on an elastic buffer material provided inside the fitting part.

7. The vibration control wall structure according to claim 6, further comprising an anchor member that fixes any one of an upper end and a lower end of the frame material to the wall frame so as to prevent rising displacement when forces in up and down directions acting from the plurality of adjacent face materials are not balanced between the side end portions of the plurality of adjacent face materials.

8. The vibration control wall structure according to claim 6, wherein the vibration control damper has a first member mounted on at least one of a front face portion and a back face portion of the face material and a second member abutting on the first member, and herein the first member slides in a contact state with the second member on a material different from a material on which the second member slides, such that the vibration control wall body is displaced in the in-plane direction so as to damp vibration acting on the building.

9. The vibration control wall structure according to claim 6, wherein the vibration control damper comprises a damping part protruding in the in-plane direction of the vibration control wall body and a support part provided on a side of the damping part, and wherein when the damping part is deformed to damp vibration acting on a building, an abutment portion abutted by the damping part and the support part is set so as to be inclined at a predetermined angle by abutting the damping part on the support part so that the damping part can be deformed in a state in which predetermined vibrating damping performance is maintained.

10. The vibration control wall structure according to claim 1, wherein in the vibration control wall body, any one of the upper end portion and the lower end portion and both side end portions of the face material are fixed to the frame material by a buffer ring mounted to a through-hole penetrating from a front face portion to a back face portion of the face material, and the frame material is fixed to at least one of the front face portion and the back face portion of the face material by a fastening member inserted through the through-hole and the buffer ring.

11. The vibration control wall structure according to claim 10, further comprising an anchor member that fixes any one of an upper end and a lower end of the frame material to the wall frame so as to prevent rising displacement when forces in up and down directions acting from the plurality of adjacent face materials are not balanced between the side end portions of the plurality of adjacent face materials.

12. The vibration control wall structure according to claim 10, wherein the vibration control damper has a first member mounted on at least one of a front face portion and a back face portion of the face material and a second member abutting on the first member, and wherein the first member slides in a contact state with the second member on a material different from a material on which the second member slides, such that the vibration control wall body is displaced in the in-plane direction so as to damp vibration acting on the building.

13. The vibration control wall structure according to claim 10, wherein the vibration control damper comprises a damping part protruding in the in-plane direction of the vibration control wall body and a support part provided on a side of the damping part, and wherein when the damping part is deformed to damp vibration acting on a building, an abutment portion abutted by the damping part and the support part is set so as to be inclined at a predetermined angle by abutting the damping part on the support part so that the damping part can be deformed in a state in which predetermined vibrating damping performance is maintained.

14. The vibration control wall structure according to claim 1, further comprising an anchor member that fixes any one of an upper end and a lower end of the frame material to the wall frame so as to prevent rising displacement when forces in up and down directions acting from the plurality of adjacent face materials are not balanced between the side end portions of the plurality of adjacent face materials.

15. The vibration control wall structure according to claim 14, wherein the vibration control damper has a first member mounted on at least one of a front face portion and a back face portion of the face material and a second member abutting on the first member, and wherein the first member slides on a first material in contact with a different material on which the second member slides, such that the vibration control wall body is displaced in the in-plane direction so as to damp vibration acting on the building.

16. The vibration control wall structure according to claim 14, wherein the vibration control damper comprises a damping part protruding in the in-plane direction of the vibration control wall body and a support part provided on a side of the damping part, and wherein when the damping part is deformed to damp vibration acting on a building, an abutment portion abutted by the damping part and the support part is set so as to be inclined at a predetermined angle by abutting the damping part on the support part so that the damping part can be deformed in a state in which predetermined vibrating damping performance is maintained.

17. The vibration control wall structure according to claim 1, wherein the vibration control damper has a first member mounted on at least one of a front face portion and a back face portion of the face material and a second member abutting on the first member, and wherein the first member slides on a first material in contact with a different material on which the second member slides, such that the vibration control wall body is displaced in the in-plane direction so as to damp vibration acting on the building.

18. The vibration control wall structure according to claim 1, wherein the vibration control damper comprises a damping part protruding in the in-plane direction of the vibration control wall body and a support part provided on a side of the damping part, and wherein when the damping part is deformed to damp vibration acting on a building, an abutment portion abutted by the damping part and the support part is set so as to be inclined at a predetermined angle by abutting the damping part on the support part so that the damping part can be deformed in a state in which predetermined vibrating damping performance is maintained.

* * * * *